US008166889B2

(12) United States Patent
Gomis

(10) Patent No.: US 8,166,889 B2
(45) Date of Patent: May 1, 2012

(54) COMMUNICATION BELLOWS BETWEEN CARS OF A RAIL VEHICLE

(75) Inventor: Christophe Gomis, Nieul sur Mer (FR)

(73) Assignee: Alstom Transport SA, Levallois-Perret (FR)

( * ) Notice: Subject to any disclaimer, the term of this patent is extended or adjusted under 35 U.S.C. 154(b) by 40 days.

(21) Appl. No.: 12/358,313

(22) Filed: Jan. 23, 2009

(65) Prior Publication Data

US 2009/0193999 A1 Aug. 6, 2009

(30) Foreign Application Priority Data

Jan. 24, 2008 (FR) ..... 08 50442

(51) Int. Cl.
*B60D 5/00* (2006.01)

(52) U.S. Cl. ..... 105/8.1; 105/9

(58) Field of Classification Search ..... 238/8.1, 238/9, 15, 18, 19, 20; 105/8.1, 9, 15, 18, 105/19, 20

See application file for complete search history.

(56) References Cited

U.S. PATENT DOCUMENTS

| | | | | |
|---|---|---|---|---|
| 2,568,684 | A * | 9/1951 | Mihalyi | 105/18 |
| 4,690,421 | A * | 9/1987 | Schmidt et al. | 280/403 |
| 4,798,148 | A * | 1/1989 | Girard | 105/17 |
| 5,033,395 | A | 7/1991 | Bechu et al. | 105/18 |
| 5,060,577 | A * | 10/1991 | Steinmetz | 105/15 |
| 5,562,042 | A * | 10/1996 | Luck et al. | 105/8.1 |
| 2005/0183622 | A1 * | 8/2005 | Petit et al. | 105/8.1 |
| 2009/0193999 | A1 * | 8/2009 | Gomis | 105/18 |

FOREIGN PATENT DOCUMENTS

| | | | |
|---|---|---|---|
| DE | 197 21 285 | A1 | 11/1998 |
| EP | 0 293 051 | A | 11/1988 |
| EP | 293051 | A1 * | 11/1988 |
| EP | 0 336 809 | A | 10/1989 |
| FR | 2 786 452 | A | 6/2000 |
| FR | 2 865 984 | A | 8/2005 |

* cited by examiner

*Primary Examiner* — S. Joseph Morano
*Assistant Examiner* — Jason C Smith
(74) *Attorney, Agent, or Firm* — Davidson, Davidson & Kappel, LLC

(57) ABSTRACT

The present invention provides a communication bellows including at least one external skin which has a succession of inwardly directed undulations and at least one internal skin which has a succession of outwardly directed undulations which are provided facing the inwardly directed undulations of the external skin, the two skins together delimiting an acoustic insulation space, the internal skin being connected to at least some of the inwardly directed undulations of the external skin, the external skin and internal skin being connected to each other only by some mutually facing undulations, other undulations of the two skins remaining separate from each other.

18 Claims, 5 Drawing Sheets

COMMUNICATION BELLOWS BETWEEN CARS OF A RAIL VEHICLE

Priority is claimed to French Patent Application No. 08 50442 filed on Jan. 24, 2008 which is hereby incorporated by reference herein.

The present invention relates to a communication bellows for a rail vehicle, of the type comprising: at least one external skin which has a succession of inwardly directed undulations and at least one internal skin which has a succession of outwardly directed undulations which are provided facing the inwardly directed undulations of the external skin.

BACKGROUND OF THE INVENTION

Rail vehicles for the transport of passengers are commonly formed by a succession of cars which communicate with each other. To that end, a communication passage is provided between the adjacent ends of two successive cars. During travel on bends, the communication passage must be able to become deformed. In this manner, it is known to use a bellows whose ends are connected to the successive cars in order to delimit the communication passage. Passengers can then move through the bellows which forms a sealed corridor.

In high-speed trains, the bellows is constituted by a single thin closed rubber profile-member, the thickness being in the order of 1.5 mm. This bellows is not completely satisfactory from an acoustic point of view. There further exist double-skin bellows, the skins each being constituted by a web covered with rubber. The two skins form successive undulations and have of themselves a bellows-like shape. The two skins are secured together by connections which are provided in the region of all the peaks of the mutually facing undulations of the two skins.

This solution is also unsatisfactory from an acoustic point of view.

SUMMARY OF THE INVENTION

An object of the invention provides a communication bellows which has good acoustic insulation properties, while at the same time ensuring a large communication width and preserving the capacity thereof for compression and deformation during displacement of the communication means.

The present invention provides a communication bellows having a closed contour, including at least one external skin which has a succession of inwardly directed undulations and at least one internal skin which has a succession of outwardly directed undulations which are provided facing the inwardly directed undulations of the external skin. The two skins together delimiting an acoustic insulation space, the internal skin being connected to at least some of the inwardly directed undulations of the external skin, wherein the external skin and internal skin are connected to each other only by some mutually facing undulations, other undulations of the two skins remaining separate from each other.

According to preferred specific embodiments, the communication bellows may include one or more of the following features:

- the inwardly directed and outwardly directed undulations of the external skin and internal skin have peaks which are provided facing each other in the same plane which is transverse relative to the bellows,
- the two skins are connected to each other at most at the mutually facing peaks of the inwardly and outwardly directed undulations,

- the proportion of mutually facing undulations of the external skin and internal skin which are connected to each other is between 30% and 60% of the total number of mutually facing undulations,
- the external skin and internal skin are connected to each other by hinges which extend over the majority of the length of the undulations of the two skins,
- the hinges comprise a first assembly of knuckles which are connected to the external skin and a second assembly of knuckles which are connected to the internal skin, the knuckles being interposed and a pin, about which they are each articulated, extending therethrough,
- the external skin and internal skin have, along each edge thereof, a fixing rim which protrudes towards the outer side and the inner side of the bellows, respectively,
- the fixing rims are secured to the edge of the external skin and internal skin by over-molding,
- the external skin and internal skin have the same thickness,
- the thickness of the external skin and internal skin is between 3 and 7 mm,
- the external skin and internal skin have, along the opposing peripheral edges thereof, assembly flats, along which the two skins are compressed against each other,
- the undulations of the external skin and internal skin have a height between 20 and 35 mm, and
- the undulations of the external skin and internal skin have, when at rest, a length between 20 and 30 mm.

The invention further provides a communication zone which comprises two end walls of two successive cars of a rail vehicle, each delimiting a passage opening and a communication bellows as defined above, which is connected to the two walls between the two passage openings.

BRIEF DESCRIPTION OF THE DRAWINGS

The invention will be better understood from a reading of the following description which is given purely by way of example with reference to the drawings, in which.

DETAILED DESCRIPTION OF THE PREFERRED EMBODIMENTS

Figure 1:
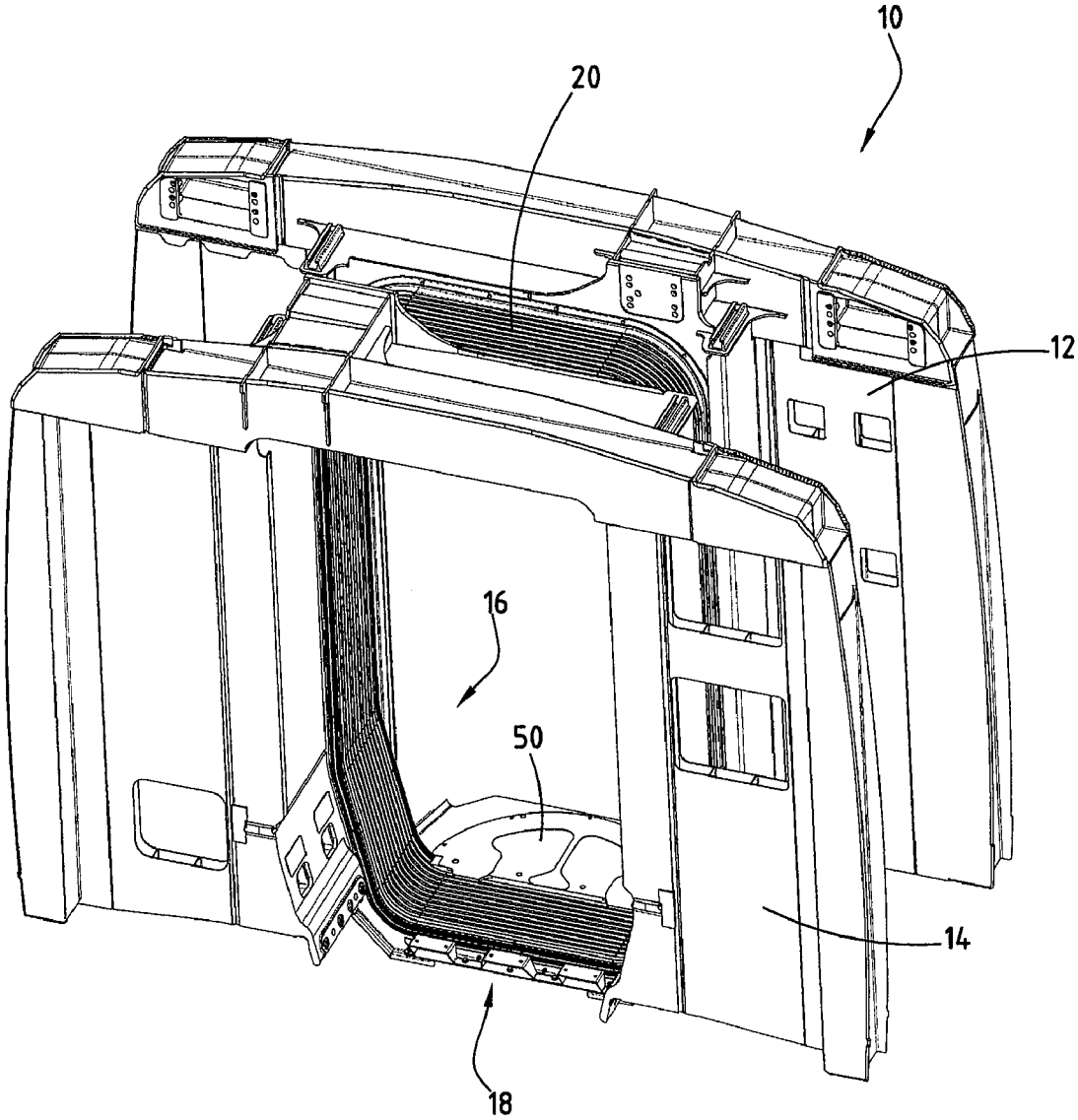
FIG. 1 is a perspective view of the communication zone between two cars, showing the communication bellows according to the invention.

The communication zone 10 illustrated in FIG. 1 is that of a train which includes high-speed rail cars which are assembled together. Such a communication zone exists between each pair of successive cars. In this manner, it comprises two walls 12, 14 which are provided at the ends of the two cars. Two openings 16, 18 are delimited through the facing walls 12, 14 for movement of passengers. Those openings are generally rectangular, the long side being arranged vertically.

A bellows 20 according to the invention is arranged between the two openings. It is connected at each of its ends to the end walls 12, 14 and forms therewith the communication zone 10.

The bellows forms a closed contour and in this manner delimits an enclosed conduit which allows movement of passengers. When viewed in section, it generally has a shape which is substantially identical to that of the openings 12, 14 in continuation of which it is installed.

Figure 2:
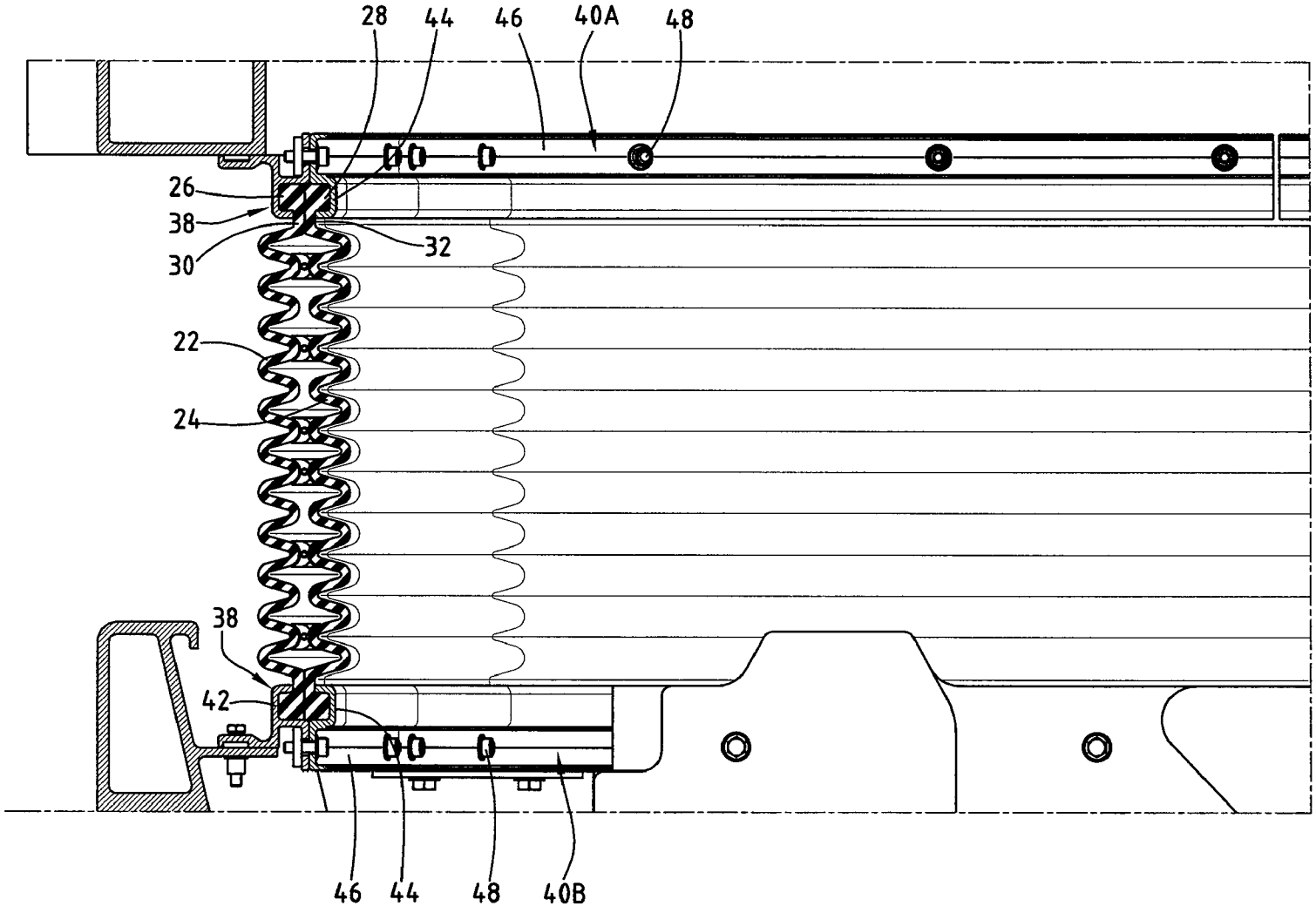
FIG. 2 is a longitudinal section of the communication zone between two cars, showing the communication bellows according to the invention.
Figure 3:
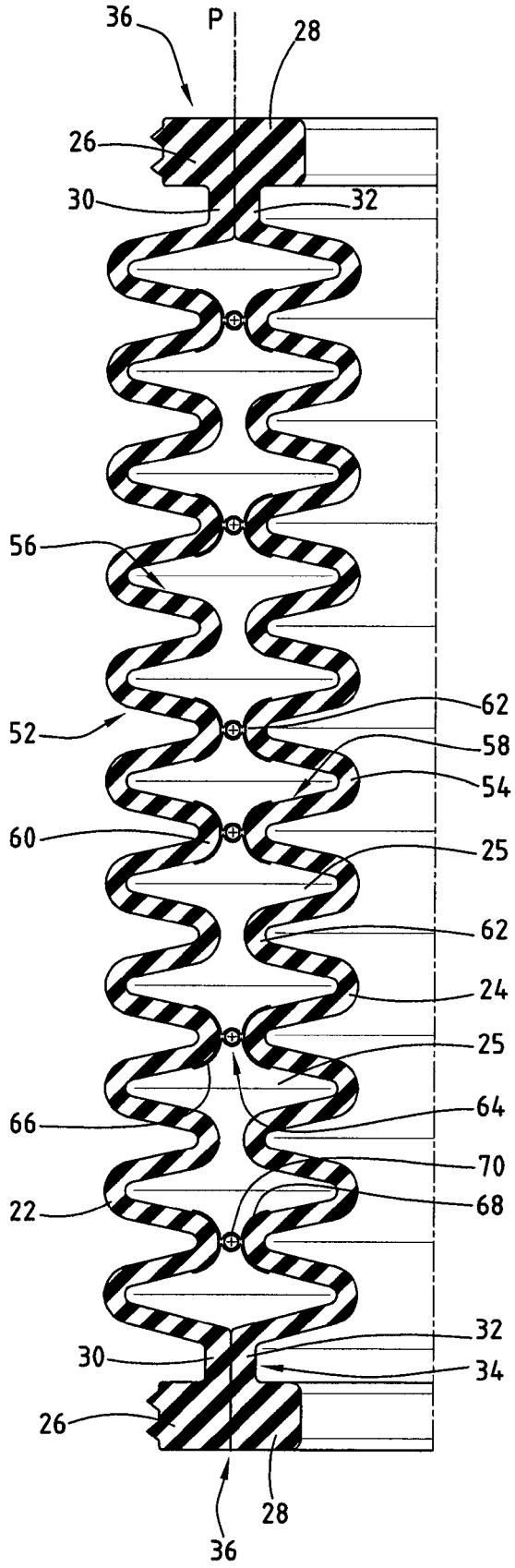
FIG. 3 is a partial section, drawn to an enlarged scale, of the communication bellows in the rest state, i.e., without any axial load.

As illustrated in FIGS. 2 and 3, the bellows comprises an external skin 22 and an internal skin 24, both undulating and being connected to each other by peripheral connections which are longitudinally spaced apart from each other. The two skins together delimit an acoustic insulation space 25 which is mainly enclosed.

The external skin 22 and internal skin 24 have at the two ends thereof peripheral rims 26, 28 which extend outwardly and inwardly relative to the bellows itself, respectively. The rims are provided in the same plane and are opposite each other. They are each formed at the end of a flat peripheral edge 30, 32 which is provided at each end of the two skins. Those flat peripheral edges 30, 32 are kept secured to each other and together form a cylindrical web 34 of the bellows which extends in the central portion of the thickness thereof in a centre plane P. In this manner, the two rims 26, 28 together form a connection shoulder 36 which protrudes radially at one side and the other of the web 34.

The fixing rims 26, 28 are preferably fitted to the edge of the external skin 22 and internal skin 24 by over-molding.

In order to connect the bellows, the connection shoulders 36 are each gripped between two connection flanges. The flange designated 38 is fixedly joined to each end wall 12, 14 and the other flange designated 40A, 40B is fitted to the associated end wall.

As illustrated in FIG. 2, the flanges 38 delimit a peripheral channel 42 which is intended for receiving the rim 26 and the opening of which is directed inwards.

Figure 4:
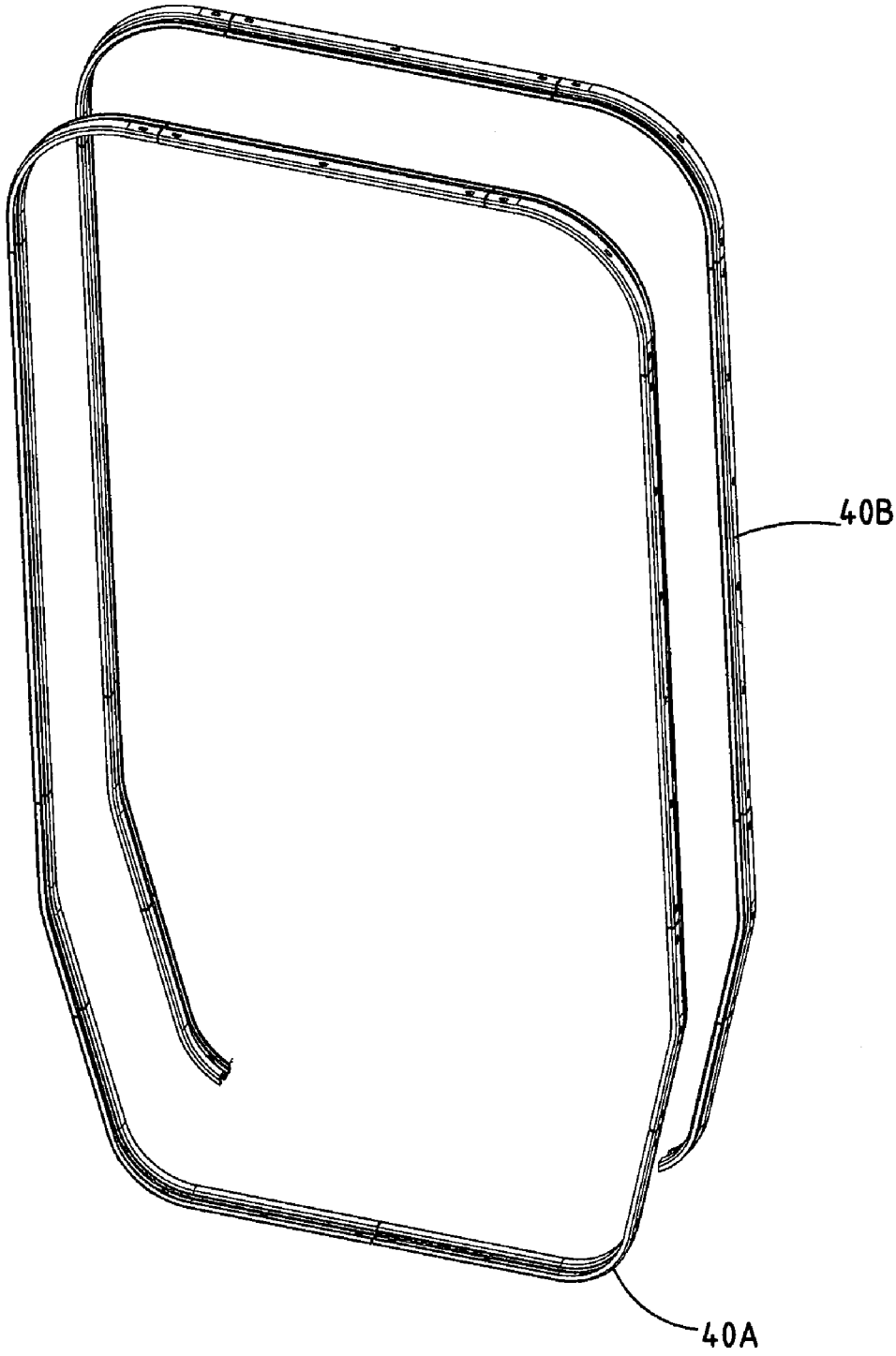
FIG. 4 is a perspective view of two flanges for retaining the ends of the communication bellows.

The flanges which are designated 40A, 40B and which are only illustrated in FIG. 4, comprise a peripheral channel 44, the opening of which is directed outwards. Each channel 44 is capable of receiving a rim 28.

The channel 44 is fixedly joined to an adjacent peripheral fixing ring 46 which bounds the channel 44 over the entire length thereof. The fixing ring 46 is perforated with holes which are regularly distributed over its length and through which assembly screws 48 which are screwed into the flanges 38 are engaged.

Whereas the flange 40A forms a closed contour, the flange 40B is interrupted along a lower side in order to allow the introduction of a threshold 50 which is visible in FIG. 1 and which ensures the retention of the bellows in that zone. To that end, the threshold delimits a channel for receiving the rim 28.

As illustrated in FIG. 3, the external skin 22 and internal skin 24 each has, in the central portion over the majority of the length thereof between the edges 32, 34, undulating zones 52, 54 which are formed by successive undulations 56, 58. Those undulations 56, 58 are displaced opposite each other at one side and the other of the centre plane P of the thickness of the bellows. In this manner, they generally extend outwards and inwards relative to the rims 26, 28.

The two skins 22, 24 have the same number of undulations 56, 58 and, when viewed in section, are mutually symmetrical relative to the centre plane P.

The undulations of the undulating zones 52, 54 are periodic and are substantially sinusoidal. The number of undulations is between 8 and 15 and is, for example, 11.

In this manner, the inwardly directed undulations 56 and outwardly directed undulations 58 of the undulating zones of the external skin 22 and internal skin 24 have peaks 60, 62 which are provided facing each other in the same plane which is transverse relative to the bellows, respectively.

The undulating zones 52, 54 of the two skins are connected to each other at most in the region of some mutually facing peaks 60, 62 of the inwardly directed and outwardly directed undulations. In this manner, the external skin 22 and internal skin 24 are connected to each other only at some peaks 60, 62 of mutually facing undulations, the other undulations of the two skins remaining separate and free with respect to each other.

In this manner, for example, approximately one peak 60 out of two is connected to the peak 62 of the other facing skin over the length of the bellows.

Preferably, the proportion of mutually facing undulations which are connected to each other is between 30% and 60%, and is preferably substantially 40% of the mutually facing undulations, and in this manner from 40% to 70% of the mutually facing undulations are not connected.

The external skin 22 and internal skin 24 are connected to each other by hinges 64 which extend over the majority of the length of the peaks of the mutually facing undulations.

To that end, the hinges comprise a first assembly of knuckles 66 which are connected to the external skin 22 and a second assembly of knuckles 68 which are connected to the internal skin 24. The knuckles 66, 68 are interposed and are articulated about a common pin 70 which extends over the entire length of the hinge and which is engaged through the successive knuckles 66, 68.

The external skin 22 and internal skin 24 have the same thickness. Preferably, the thickness of undulating zones 52, 54 of the external skin 22 and internal skin 24 is between 3 and 7 mm. It is preferably substantially 4.5 mm. The two skins are self-supporting and are formed by a suitable rubber material. The skins comprise only rubber and do not comprise any fabrics, or any other matrix, for supporting the rubber.

The undulations have a height which is between 20 and 35 mm and preferably substantially 27 mm. The undulations have, when at rest, a length which is between 20 and 30 mm.

Figure 5:
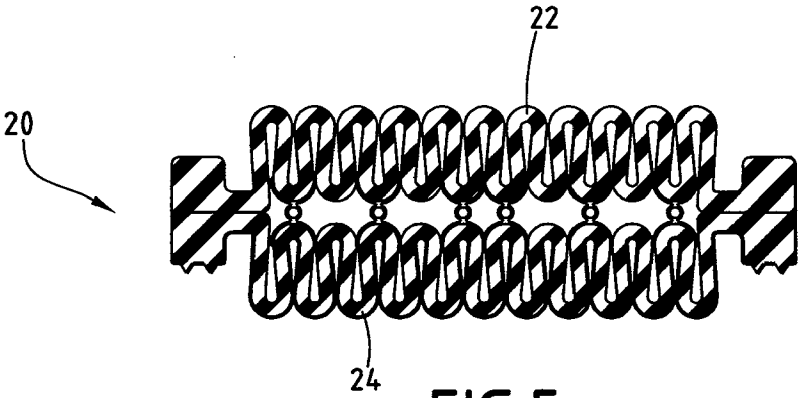
FIG. 5 is a view which is identical to that of FIG. 3, the communication bellows being in its compressed state.
Figure 6:
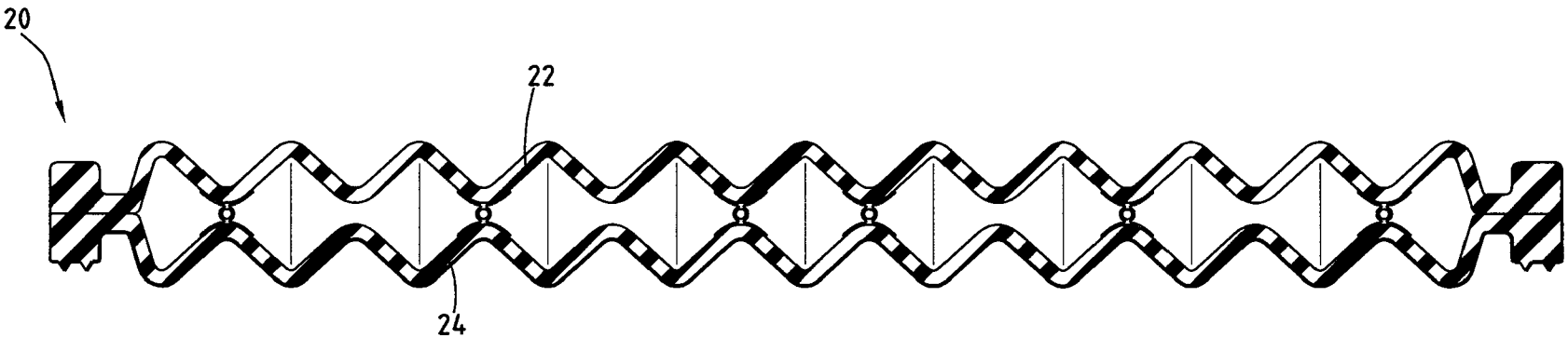
FIG. 6 is a view which is identical to that of FIG. 3, the communication bellows being in its extended state.

In this manner, the undulating zones 52, 54 of the bellows have, when at rest, a length which is substantially, for example, 258 mm, this being reduced to, for example, 190 mm when the bellows is in its compressed state as illustrated in FIG. 5, and increasing to, for example, 410 mm when the bellows is in its extended state as illustrated in FIG. 6.

Owing to its double skin, the bellows can be inflated during assembly in order to reach its positioning dimension and to facilitate assembly. Placement in a mold in order to form the definitive bellows from the extruded rubber profile which forms the undulating zones 52, 54 allows integration of an operation for adding a different material to the periphery of the bellows which forms the connection shoulder 36, having a hardness and shape suitable for improving the sealing of the assembly at the ends of the cars.

Since the number of connections between the two skins is smaller, the disadvantageous effect thereof from the point of view of acoustic insulation may be reduced while allowing good cohesion of the bellows for traveling on bends and resistance to loads owing to pressure waves.

What is claimed is:

1. A communication bellows having a closed contour comprising:

at least one external skin which has a succession of inwardly directed undulations;

at least one internal skin which has a succession of outwardly directed undulations which are provided facing the inwardly directed undulations of the external skin;

the internal skin and external skin together delimiting an acoustic insulation space, the two skins having a closed cross-section;

some of the inwardly directed undulations of the external skin being connected to at least some of the outwardly directed undulations of the internal skin, thereby connecting the external skin and internal skin;

remaining undulations of the internal skin and external skin being separate from each other; and hinges flexibly connecting the inwardly directed undulations and outwardly directed undulations which extend over a majority of a length of the inwardly directed undulations and outwardly directed undulations.

2. The communication bellows according to claim 1, wherein the inwardly directed undulations and outwardly directed undulations of the external skin and internal skin have peaks which are provided facing each other in the same plane which is transverse relative to the bellows.

3. The communication bellows according to claim 2, wherein the internal skin and external skin are connected to each other by at least one of the mutually facing peaks of the inwardly directed undulations and outwardly directed undulations.

4. The communication bellows according to claim 1, wherein the hinges include a first assembly of knuckles which are connected to the external skin and a second assembly of knuckles which are connected to the internal skin, the knuckles being interposed and articulated about a pin extending therethrough.

5. The communication bellows according to claim 1, wherein the external skin and internal skin have, along each edge thereof, a fixing rim which protrudes towards the outer side and the inner side of the bellows, respectively.

6. The communication bellows according to claim 5, wherein the fixing rims are secured to the edge of the external skin and internal skin by over-molding.

7. The communication bellows according to claim 1, wherein the external skin and internal skin have the same thickness.

8. The communication bellows according to claim 1, wherein the thickness of the external skin and internal skin is between 3 and 7 mm.

9. The communication bellows according to claim 1, wherein the external skin and internal skin have, along the opposing peripheral edges thereof, assembly flats, along which the internal skin and external skin are compressed against each other.

10. The communication bellows according to claim 1, wherein the undulations of the external skin and internal skin have a height which is between 20 and 35 mm.

11. The communication bellows according to claim 1, wherein the undulations of the external skin and internal skin have, when at rest, a length which is between 20 and 30 mm.

12. The communication bellows according to claim 1, wherein a number of undulations is between 8 and 15.

13. The communication bellows according to claim 1, wherein the number of undulations is 11.

14. The communication bellows according to claim 1, wherein a proportion of mutually facing undulations of the external skin and internal skin which are connected to each other is between 30% and 60% of the total number of mutually facing undulations.

15. The communication bellows according to claim 1, wherein a proportion of mutually facing undulations of the external skin and internal skin which are not connected to each other is between 70% and 40% of the total number of mutually facing undulations.

16. The communication bellows according to claim 1 wherein approximately one of every two mutually facing undulations are connected to each other over the lengths of the two skins.

17. A communication bellows having a closed contour comprising:

at least one external skin which has a succession of inwardly directed undulations;

at least one internal skin which has a succession of outwardly directed undulations which are provided facing the inwardly directed undulations of the external skin;

the two skins together delimiting an acoustic insulation space, the internal skin being connected to at least some of the inwardly directed undulations of the external skin, wherein the external skin and internal skin have a closed cross-section and are connected to each other only by some mutually facing undulations, remaining undulations of the internal skin and external skin being separate from each other, wherein the external skin and internal skin are connected to each other by hinges which extend over a majority of a length of the inwardly directed undulations and outwardly directed undulations; and wherein the hinges include a first assembly of knuckles which are connected to the external skin and a second assembly of knuckles which are connected to the internal skin, the knuckles being interposed and articulated about a pin extending therethrough.

18. The communication bellows according to claim 17 wherein a proportion of mutually facing undulations of the external skin and internal skin which are connected to each other is between 30% and 60% of the total number of mutually facing undulations.

* * * * *